US009096055B2

(12) United States Patent
Liu et al.

(10) Patent No.: US 9,096,055 B2
(45) Date of Patent: Aug. 4, 2015

(54) SYSTEMS AND METHODS FOR INK-BASED DIGITAL PRINTING

(71) Applicant: Xerox Corporation, Norwalk, CT (US)

(72) Inventors: Chu-heng Liu, Penfield, NY (US); Jing Zhou, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 6 days.

(21) Appl. No.: 13/719,219

(22) Filed: Dec. 18, 2012

(65) Prior Publication Data

US 2014/0168329 A1 Jun. 19, 2014

(51) Int. Cl.
*B41L 23/00* (2006.01)
*B41J 2/01* (2006.01)

(52) U.S. Cl.
CPC ..... *B41J 2/01* (2013.01); *B41J 2002/012* (2013.01)

(58) Field of Classification Search
CPC ..... B41J 2/01; B41J 2002/012; B41C 1/1033; B41M 5/5236
USPC ..... 101/147, 351.8, 491
See application file for complete search history.

(56) References Cited

U.S. PATENT DOCUMENTS

| | | | | |
|---|---|---|---|---|
| 4,729,310 | A * | 3/1988 | Love, III | 101/157 |
| 2005/0264641 | A1* | 12/2005 | Katano et al. | 347/171 |
| 2007/0199462 | A1* | 8/2007 | Cyman et al. | 101/211 |
| 2009/0079807 | A1* | 3/2009 | Yamashita et al. | 347/102 |
| 2009/0268002 | A1* | 10/2009 | Houjou | 347/95 |
| 2011/0316926 | A1* | 12/2011 | Breton et al. | 347/20 |

* cited by examiner

*Primary Examiner* — Matthew G Marini

(74) *Attorney, Agent, or Firm* — Ronald E. Prass, Jr.; Prass LLP

(57) ABSTRACT

An ink-based digital printing system for variable data lithographic printing includes an imaging member and a dampening fluid/carrier patterning system. An inkjet-type device of the patterning system jets material onto an imaging member. The as-jetted material includes dampening fluid and carrier component such as a wax jetted in a single phase. Upon contact with a surface of an imaging member, the jetted material cools and phase separation occurs, the dampening fluid leaching to a surface of the solid component on the imaging member surface, dampening the solid component, which forms an image according to image data input to the patterning system.

14 Claims, 4 Drawing Sheets

SYSTEMS AND METHODS FOR INK-BASED DIGITAL PRINTING

FIELD OF DISCLOSURE

The disclosure relates to ink-based digital printing. In particular, the disclosure relates to methods and systems for ink-based digital printing using a dampening fluid image formed by jetting a multi-component single phase imaging fluid including a dampening fluid component and a carrier component that solidifies upon contacting a fluid receiving surface.

BACKGROUND

Related art ink-based digital printing systems, or variable data lithography systems configured for digital lithographic printing, include an imaging system for laser patterning a layer of dampening fluid applied to an imaging member. The imaging system includes a high power laser for emitting light energy. The imaging system is costly; this and technical challenges such as the need for stitching together laser beams increases overall system costs. The imaging member must include a costly reimageable surface layer, such as a plate or blanket that is capable of absorbing light energy. While high print speeds and reduced system and operating costs are generally desirable, print speeds achieved using related art ink-based digital printing systems are limited by the laser imaging process.

SUMMARY

Systems and methods are provided that enable high resolution dampening fluid patterning for ink-based digital printing. Systems and methods may include a device, such as an inkjet printhead, for ejecting or otherwise depositing a multi-component single phase imaging fluid onto an imaging member to form a pattern or image according to variable image data. The imaging fluid comprises a dampening fluid component and a carrier component that are miscible and in a same liquid phase at a jetting temperature. The components are phase-separated at a lower temperature, such as a temperature of the imaging fluid components upon contacting the imaging member or fluid receiving surface. The carrier solidifies on the imaging fluid receiving surface, and the dampening fluid migrates to a surface of the carrier component, forming a dampening fluid pattern or image that may be inked, or in alternative embodiments, transferred to a transfer member for inking.

Systems and methods may include a transfer member configured to define a dampening fluid pattern loading nip at which the dampening fluid pattern or image is transferred to the transfer member for subsequent inking. It has been found that a size of an inkjet droplet deposited onto a surface of the imaging member may have a diameter that is excessive as the jetted fluid spreads to a desired thickness on a surface of the imaging member. For example, a 1 picoliter drop may spread to have to a diameter of 36 micrometers at a thickness of 1 micrometer. A 10 picoliter drop has been found to spread to a 113 micrometer diameter at a thickness of 1 micrometer.

Systems and methods are provided that use a dampening fluid associated with a carrier component such as wax for dampening fluid pattern or image formation. The dampening fluid and carrier may be jetted from, e.g., an inkjet-type device. At a jetting temperature, the dampening fluid and the solid carrier are miscible, forming a single substantially liquid phase whereby jetting is uniform. Upon contact of the jetted dampening fluid/carrier with a low temperature (e.g., ambient temperature) surface of an imaging member, the jetted drop phase separates whereby the carrier solidifies on the substrate and a sufficient amount of the dampening fluid leaches to a surface of the solid carrier, separating therefrom. If the jetted dampening fluid/carrier droplet(s) contain a large volume fraction of solid carrier as preferred, the jetted drop solidifies on the substrate surface before undesired spreading to maintain a desired, e.g., "spot" or "dot" size on the imaging member surface.

A resulting spot or plurality of dots may form a solid pattern or image dampened with dampening fluid as the dampening fluid phase-separates from the solid carrier. The image may be inked, and the resulting ink image transferred using system configurations in accordance with embodiments.

An ink-based digital printing system useful for ink printing may include an imaging member; and a dampening fluid patterning system configured to jet imaging fluid comprising dampening fluid and carrier onto a surface of the imaging member according to image data, the dampening fluid and the carrier being miscible and in a single fluid phase at the jetting temperature. The dampening fluid patterning system may include an inkjet apparatus configured to jet the imaging fluid onto the surface of the imaging member. The jetted dampening fluid may form a high resolution image on the surface of the imaging member, the dampening fluid phase-separating from the solid carrier on the surface of the imaging member.

In an embodiment, systems may include a transfer member, the transfer member being configured to receive a dampening fluid pattern from a surface of the imaging member, the transfer member and the imaging member being arranged to define a dampening fluid image loading nip for contact transfer, the dampening fluid being separate from and immiscible with solid carrier on the imaging member surface.

In an embodiment, systems may include the dampening fluid comprising fountain solution. In an embodiment, systems may include the dampening fluid comprising a silicone fluid. In an embodiment, systems may include the carrier comprising paraffin. In an embodiment, systems may include an imaging member cleaning system, the imaging member cleaning system including a heating system and a doctor blade. Systems may include the dampening fluid and the carrier being miscible and in a same phase at a temperature of the dampening fluid and carrier as jetted from the patterning system.

In an embodiment, methods may include methods for ink-based digital printing, comprising forming a dampening fluid pattern on a surface of an imaging member by jetting material in a single phase, the material comprising dampening fluid and carrier. Methods may include inking the imaging member surface to produce an inked image according to the formed dampening fluid pattern. Alternatively, methods may include transferring the dampening fluid pattern to a transfer member at a dampening fluid pattern loading nip defined by the transfer member and the imaging member. Methods may include inking a surface of the transfer member having the dampening fluid pattern to produce an ink pattern according to the dampening fluid pattern. Methods may include transferring the ink pattern to a substrate at an ink pattern transfer nip formed by the transfer member and a substrate transport system. Methods may include transferring the ink pattern to a substrate at an ink pattern transfer nip formed by the imaging member and a substrate transport system. In methods, the dampening fluid and solid carrier are configured whereby the dampening fluid and carrier are miscible at a jetting temperature and are jetted in a single phase, and wherein the dampening fluid and carrier phase separate upon contacting the imaging member, the carrier being deposited in a pattern according to image data, and the dampening fluid leaching to a surface of and dampening the carrier to form the dampening fluid pattern.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
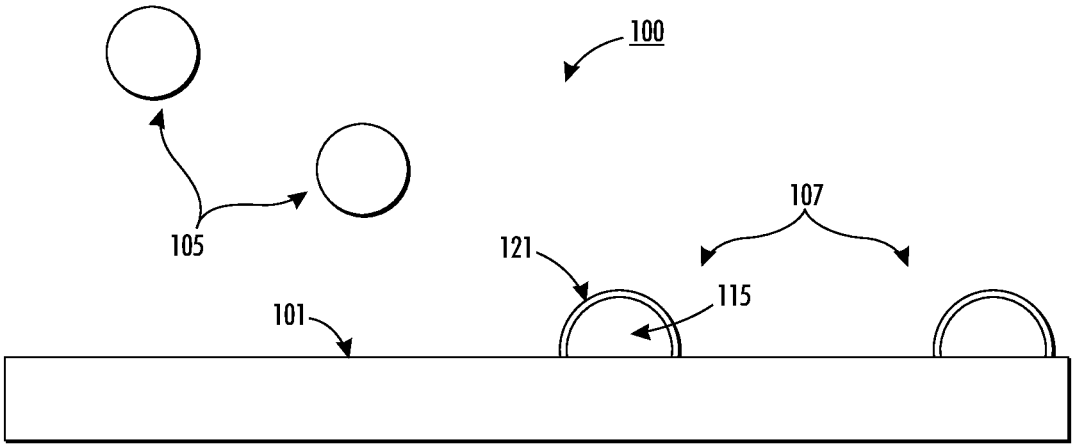
FIG. 1 shows solid ink droplets being deposited onto a surface of an imaging member in accordance with exemplary embodiment.

Exemplary embodiments are intended to cover all alternatives, modifications, and equivalents as may be included within the spirit and scope of the apparatus and systems as described herein.

Reference is made to the drawings to accommodate understanding of systems and methods for ink-based digital printing using an inkjet to form a dampening fluid pattern or image using dampening fluid associated with a carrier component that solidifies upon contacting a substrate and reaching a temperature lower than a jetting temperature. In the drawings, like reference numerals are used throughout to designate similar or identical elements. The drawings depict various embodiments of illustrative systems and methods for ink-based digital printing using a jetted material comprising a dampening fluid component and a solidifying component for high-resolution dampening fluid image formation.

Related art ink-based digital printing systems that use high power lasers for laser patterning dampening fluid on an imaging plate can be costly and have limited print speeds. U.S. patent application Ser. No. 13/095,714 (the 714 application), which is commonly assigned and the disclosure of which is incorporated by reference herein in its entirety, proposes systems and methods for providing variable data lithographic and offset lithographic printing or image receiving medium marking. The systems and methods disclosed in the 714 application are directed to improvements on various aspects of previously-attempted variable data imaging lithographic marking concepts based on variable patterning of dampening fluids to achieve effective truly variable digital data lithographic printing.

According to the 714 application, a reimageable surface is provided on an imaging member, which may be a drum, plate, belt or the like. The reimageable surface may be composed of, for example, a class of materials commonly referred to as silicones, including polydimethylsiloxane (PDMS) among others. The reimageable surface may be formed of a relatively thin layer over a mounting layer, a thickness of the relatively thin layer being selected to balance printing or marking performance, durability and manufacturability.

The imager used in such variable data lithography systems is expensive and imposes substantial technical challenges. To obviate the requirement of a high power laser imager, inkjet systems configured for developing a dampening fluid image were considered. It has been found, however, that a size of an inkjet drop of dampening fluid jetted onto a substrate is excessively large as the drop spreads to a desired thickness. For example, a 1 picoliter drop of fountain solution deposited onto a substrate surface may spread to a spot or dot size of 36 micrometers in diameter at 1 micrometers of thickness. A dampening fluid spot or dot size of a 1 picoliter deposited droplet of fountain solution may spread to a diameter of 51 micrometers at 0.50 micrometers thick. A 10 picoliter drop may become a dot having a diameter of 113 micrometers after spreading to a dot thickness of 1 micrometer, for example. A thicker-than-desired layer of jetted dampening fluid on an imaging member surface can cause an inker to force an unstable hydrodynamic flow of fluid at an inking nip, among other deleterious effects. This results in various image defects and excessive fountain solution pick-up by the inker.

Ink-based digital printing systems and methods are provided that use dampening fluid associated with a carrier component that solidifies upon contacting a receiving surface for high resolution dampening fluid image generation in variable data lithography printing. At an elevated jetting temperature, the dampening fluid and the carrier, which may comprise typical solid ink materials such as wax, are in a single, substantially liquid phase, thereby enabling uniform jetting. Upon contact of a jetted drop of imaging fluid with a low temperature (e.g., ambient temperature) surface such as an imaging member, the jetted drop dampening fluid and carrier components phase-separate. Where a large volume fraction of solid carrier is provided, the jetted drop solidifies before undesired spreading to maintain a desired "spot" or "dot" size on the imaging member surface.

A resulting dot or plurality of dots may form a solid carrier pattern or image dampened with dampening fluid that has phase-separated from the solid carrier. The inked image may be developed and transferred using system configurations in accordance with embodiments.

The dampening fluid and solid carrier are configured so that at a jetting temperature of a jetted droplet comprising a dampening fluid component associated with a solid carrier component, the dampening fluid forms a single substantially liquid phase with the solid carrier. The dampening fluid and associated solidifying carrier are configured so that as the jetted droplet contacts a lower temperature substrate, such as an imaging member or recording medium, the jetted liquid droplet phase-separates, the solid carrier component separating from the liquid dampening fluid component to form a dampening fluid pattern. The dampening fluid and solid carrier component combination is preferably configured to include a large fraction of solid carrier, or a fraction that enables the jetted droplet to solidify on the substrate while maintaining a small dot size. As the droplet cools on the imaging member surface, the dampening fluid leaches out, resulting in a raised solid pattern or image dampened with dampening fluid. The dampening fluid image may comprise one or a plurality of dots formed by jetted dampening fluid/carrier droplets. The dampening fluid image may be inked and/or transferred in accordance with methods and systems of embodiments useful for digital ink-based printing on various recording mediums.

FIG. 1 shows imaging fluid droplets and jetted dampening fluid and carrier in accordance with embodiments. In particular, FIG. 1 shows a system 100 including a substrate 101 onto which dampening fluid associated with carrier is deposited from an inkjet or inkjet-type device. The dampening fluid/carrier droplet may comprise two or more material components for jetting to create a dampening fluid image for ink-based digital printing. At least a first of the two or more components is dampening fluid, such as fountain solution, water, water-based solution, organic solvent, silicone oil such as D4, D5, D6, OS10, OS20, Novec fluids, etc., and other suitable fluids now known or later developed. The dampening fluid is selected to be liquid at room temperature, and/or a temperature of the fluid on the substrate.

At least a second of the two or more components, a carrier component, is substantially a solid at room temperature, and/or at a temperature of the carrier on the substrate, and/or at a temperature lower than a jetting temperature of the imaging fluid. The solid component may be wax, such as paraffin, D3, etc.

At a jetting temperature, a temperature of the imaging fluid before and/or during ejection from an inkjet or inkjet-type device, the components are miscible such that they form a substantially single phase suitable for uniform jetting. The two components are selected such that they phase-separate upon contact with an imaging member after jetting. As such, substantial dampening fluid spreading as in related art systems is reduced. For example, the rapid solidification of the jetted material on the substrate surface enables a drop of 25 picoliters to spread and hold a spot size of less than 50 micrometers when D4 and wax carrier are used at 50/50 mix. The dampening fluid phase-separates from the solidified component as the drop contacts the substrate, and leaches to the surface, enabling formation of a very thin dampening fluid layer. The fraction of dampening fluid and/or solid component can be adjusted to achieve a desired dampening fluid layer thickness on the substrate surface. In some related art systems, the ink-based digital printing material set, e.g., imaging member or plate, dampening fluid, and/or ink, typically requires the dampening fluid layer to be about 0.1 micrometers to 1.0 micrometer thick.

FIG. 1 shows jetted droplets 105 comprising dampening fluid and carrier. The droplets 105 are jetted from an inkjet or inkjet type device at a first temperature. The dampening fluid and carrier are miscible at the first temperature, the dampening fluid/carrier being jetted at a temperature at which the components are in same, substantially liquid phase. FIG. 1 shows deposited droplets 107 disposed on a surface of the receiving member, substrate 101. The deposited dampening fluid/solid carrier drops 107 form spots comprising phase-separated solid component 115 and liquid dampening fluid component 121. The dampening fluid separates from the solid, migrating to a surface of the solid component 115, which contacts the substrate. The height of the deposited drop 107 or spot from the surface of the receiving member 101 may be adjusted by adjusting a fraction of the dampening fluid and solid components.

Figure 2:
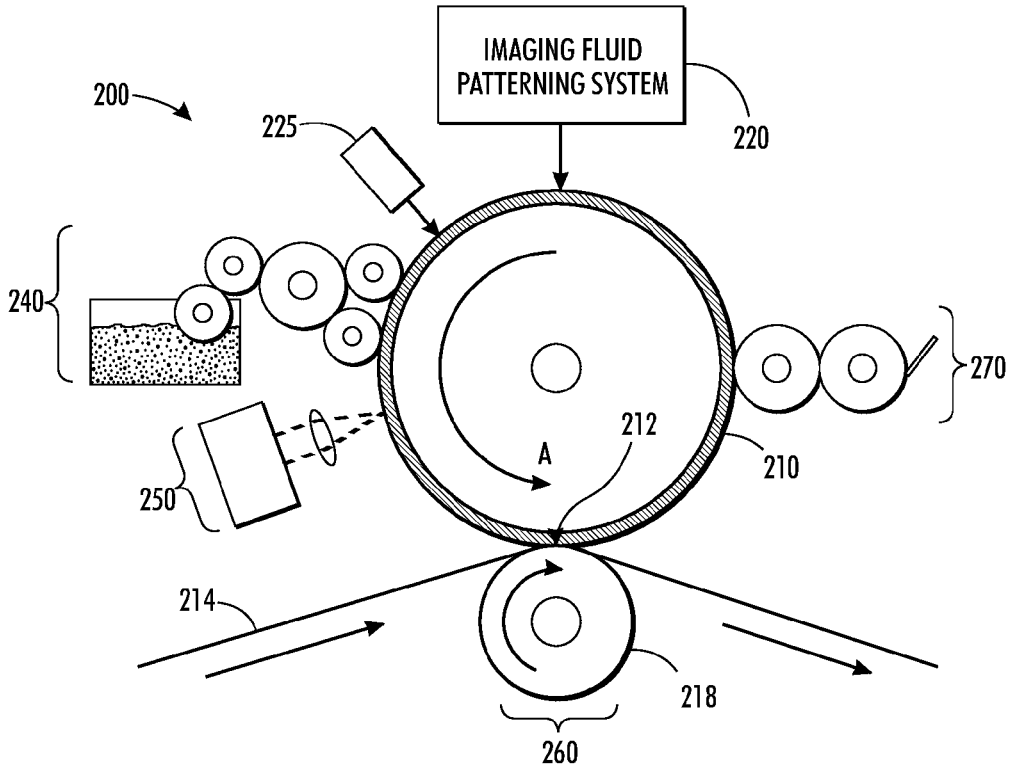
FIG. 2 shows a ink-based digital printing system in accordance with an embodiment.

The 714 application describes an exemplary variable data lithography system for ink-based digital printing, such as that shown, for example, in FIG. 2. A general description of the exemplary system 200 shown in FIG. 2 is provided here. Additional details regarding individual components and/or subsystems shown in the exemplary system 200 of FIG. 2 may be found in the 714 application. The system shown in FIG. 2, however, is configured for jetting multi-component single-phase imaging fluid droplets that phase-separate at a temperature of a receiving member surface onto which the droplets are deposited according to digital image data for forming a dampening fluid image.

As shown in FIG. 2, the exemplary system 200 may include an imaging member 210. The imaging member 210 in the embodiment shown in FIG. 2 is a drum, but this exemplary depiction should not be interpreted so as to exclude embodiments wherein the imaging member 210 includes a plate or a belt, or another now known or later developed configuration. The imaging member 210 is used to apply an ink image to an image receiving media substrate 214 at a transfer nip 212. The transfer nip 212 is formed by an impression roller 218, as part of an image transfer mechanism 260, exerting pressure in the direction of the imaging member 210. Image receiving medium substrate 214 should not be considered to be limited to any particular composition such as, for example, paper, plastic, or composite sheet film. The exemplary system 200 may be used for producing images on a wide variety of image receiving media substrates. The 714 application also explains the wide latitude of marking (printing) materials that may be used, including marking materials with pigment densities greater than 10% by weight. As does the 714 application, this disclosure will use the term ink to refer to a broad range of printing or marking materials to include those which are commonly understood to be inks, pigments, and other materials which may be applied by the exemplary system 200 to produce an output image on the image receiving media substrate 214.

The 714 application depicts and describes details of the imaging member including the imaging member being comprised of a reimageable surface layer formed over a structural mounting layer that may be, for example, a cylindrical core, or one or more structural layers over a cylindrical core. Systems that use a dampening fluid patterning system for forming a dampening fluid image reduce reliance on such measures.

For example, dampening fluid patterning systems use an inkjet or inkjet-type device for jetting dampening fluid onto the imaging member according to variable image data. The resulting dampening fluid image may be transferred to another member, as in some embodiments, or inked on the imaging member, and the subsequent inked image transferred to a recording medium as in the embodiment shown in FIG. 2. Rather than jetting only liquid dampening fluid, systems in accordance with embodiments use at least a dampening fluid component and a carrier component jetted in a single phase at a temperature at which the two or more components are miscible. This embodiment uses an inkjet patterning system that jets the dampening fluid/solid carrier droplets onto an imaging member for subsequent inking on the same surface, the fluid image being formed by phase separation as the jetted drops contact the imaging member surface causing a fraction of the dampening fluid to separate from and migrate to a surface of the solid carrier. Ink may be applied to the resulting phase-separated dampening fluid image, selectively adhering to portions of the imaging member surface accordingly.

The exemplary system 200 includes a dampening fluid subsystem 220 generally comprising an inkjet or inkjet-type device configured for jetting multi-component single phase imaging fluid onto an imaging member surface in accordance with variable data input from a connected data source. As indicated above, it is known that a dampening fluid such as fountain solution may comprise mainly water optionally with small amounts of isopropyl alcohol or ethanol added to reduce surface tension. Small amounts of certain surfactants may be added to the fountain solution as well. Alternatively, other suitable dampening fluids may be used to enhance the performance of ink based digital lithography systems. Suitable dampening fluids are disclosed, by way of example, in co-pending U.S. patent application Ser. No. 13/284,114, titled DAMPENING FLUID FOR DIGITAL LITHOGRAPHIC PRINTING, the disclosure of which is incorporated herein by reference in its entirety.

Once the dampening fluid is patterned onto the surface of the imaging member 210, phase-separated from the solid carrier component of the jetted dampening fluid/carrier single-phase droplets, a thickness of the dampening fluid dot(s) or layer of jetted material formed of a plurality of droplets may be measured using a sensor 225 that may provide feedback to control. The inkjet may be controlled to jet dampening fluid/carrier in a manner that yields a desired thickness of dampening fluid. The dampening fluid patterning system or subsystem 220 comprising an inkjet is configured for forming a latent image in the uniform dampening fluid layer by image-wise jetting droplets on the imaging member surface.

The dampening fluid image comprising solid carrier deposited on the imaging member surface and dampening with dampening fluid is presented to an inker subsystem 240. The inker subsystem 240 is used to apply a uniform layer of ink over the layer of dampening fluid and surface layer of the imaging member 210. The inker subsystem 240 may use an anilox roller to meter an offset lithographic ink onto one or more ink forming rollers that are in contact with the surface layer of the imaging member 210. Separately, the inker subsystem 240 may include other traditional elements such as a series of metering rollers to provide a precise feed rate of ink to the imaging member surface.

The cohesiveness and viscosity of the ink residing on the surface layer of the imaging member 210 may be modified by a number of mechanisms. One such mechanism may involve the use of a rheology (complex viscoelastic modulus) control subsystem 250. The rheology control system 250 may form a partial crosslinking core of the ink on the surface to, for example, increase ink cohesive strength relative to the surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the surface of the imaging member 210 to a substrate of image receiving medium 214 using a transfer subsystem 260. The transfer occurs as the substrate 214 is passed through a nip 212 between the imaging member 210 and an impression roller 218 such that ink on the surface of the imaging member 210 is brought into physical contact with the substrate 214. With the adhesion of the ink having been modified by the rheology control system 250, modified adhesion of the ink causes the ink to adhere to the substrate 214 and to separate from the surface of the imaging member 210. Careful control of the temperature and pressure conditions at the transfer nip 212 may allow transfer efficiencies for the ink from the surface of the imaging member 210 to the substrate 214 to exceed 95%. While it is possible that some dampening fluid may also wet substrate 214, the volume of such a dampening fluid will be minimal, and will rapidly evaporate or be absorbed by the substrate 214.

In certain offset lithographic systems, it should be recognized that an offset roller, not shown in FIG. 2, may first receive the ink image pattern and then transfer the ink image pattern to a substrate according to a known indirect transfer method.

Following the transfer of the majority of the ink to the substrate 214, any residual ink and/or residual dampening fluid and solid carrier must be removed from the surface of the imaging member 210, preferably without scraping or wearing that surface. An air knife 275 may be employed to remove residual dampening fluid. It is anticipated, however, that some amount of ink residue and a significant amount the solid carrier may remain. Removal of such remaining ink residue may be accomplished through use of some form of cleaning subsystem 270. The 714 application describes details of such a cleaning subsystem 270 including at least a first cleaning member such as a sticky or tacky member in physical contact with the surface of the imaging member 210, the sticky or tacky member removing residual ink and any remaining small amounts of surfactant compounds from the dampening fluid of the reimageable surface of the imaging member 210. The sticky or tacky member may then be brought into contact with a smooth roller to which residual ink may be transferred from the sticky or tacky member, the ink being subsequently stripped from the smooth roller by, for example, a doctor blade.

Due to the hot-melt nature of the carrier component, it is advantageous to apply heat to the solid carrier residue during cleaning and remove the solid carrier while it is in a liquid state. Conventional liquid removal methods and devices can be used such as squeegee rolls, blotter, blade and etc. The removed solid carrier can be purified and reused.

The 714 application details other mechanisms by which cleaning of the surface of the imaging member 210 may be facilitated. Regardless of the cleaning mechanism, however, cleaning of the residual ink, dampening fluid and the solid carrier from the surface of the imaging member 210 is essential to preventing ghosting in the proposed system. Once cleaned, the surface of the imaging member 210 is again presented to the dampening fluid patterning system or subsystem 220 by which a fresh layer of dampening fluid is supplied to the reimageable surface of the imaging member 210, and the process is repeated.

It has been found that implementing an ink jet system for jetting mere dampening fluid onto an imaging member can result in excessive dampening fluid at the inking system, making it difficult to achieve a high resolution image. For example, a size of an ink jet dampening fluid droplet deposited on a surface of a typical imaging plate is undesirably large after spreading to a desired thickness of about 1 micrometer. To achieve higher image fidelity, there is a desire to use an even thinner layer of dampening fluid, in the range of 0.1 to 0.5 micrometers. For example, a one picoliter drop will spread to a spot size of 36 micrometers in diameter at one micrometer of thickness. A one picoliter drop will spread to a spot size of 51 micrometers at 0.5 micrometers of thickness upon contact with a receiving surface such as an imaging member. A 10 picoliter drop may spread to a spot size of 113 micrometers at one micrometer thickness, and a spot size of 160 micrometers at 0.5 micrometer thickness. Further, the dampening fluid droplet may not be able to spread to a desired thickness, e.g., about one micrometer or thinner, within a desired timeframe. Consequently, a thick layer of dampening fluid may result and cause an inker to force an unstable hydrodynamic flow of dampening fluid at an inking nip. This may result in various image defects and excessive dampening fluid pickup by the inker.

A preferred embodiment as illustrated by FIG. 2 has addressed the foregoing challenges by jetting an imaging fluid material comprising dampening fluid along with a significant fraction of carrier that solidifies, but is miscible with and in a same liquid phase as the dampening fluid at an elevated jetting temperature. However, the cleaning of the solid carrier from, e.g., a conformable imaging member (silicone rubber for example) is challenging. Furthermore, the purification of the removed solid carrier for reuse is necessary because the collected solid carrier is contaminated with ink residues.

Other arrangements have been provided that address the foregoing challenges by incorporating a dampening fluid absorbing imaging member. In particular, systems configured for forming and transferring a dampening fluid image for subsequent inking are disclosed in co-pending U.S. application Ser. No. 13/599,380, titled SYSTEMS AND METHODS FOR INK-BASED DIGITAL PRINTING USING IMAGING MEMBER AND IMAGE TRANSFER MEMBER, the disclosure of which is incorporated by reference herein in its entirety, and co-pending U.S. application Ser. No. 13/599,004 titled SYSTEMS AND METHODS FOR INK-BASED DIGITAL PRINTING USING DAMPENING FLUID IMAGING MEMBER AND IMAGE TRANSFER MEMBER, the disclosure of which is incorporated by reference herein in its entirety.

Such systems and methods of embodiments divide imaging plate functionality between two distinct physical members: an imaging member that receives dampening fluid, and a transfer member that receives marking material such as ink from an adjacent inking system. The imaging member and the transfer member may be rolls or cylinders. The imaging member may be configured to absorb dampening fluid on a surface thereof, where the dampening fluid is jetted to form a high resolution image. The imaging member may be configured, for example, to spread most of the dampening fluid uniformly to form a high quality dampening fluid image.

The imaging member may then be brought into contact with a transfer member that receives the dampening fluid image. The imaging member and the transfer member may define a dampening fluid image (or pattern) loading nip for contact transfer of the dampening fluid pattern or image from the imaging member to the transfer member. At the loading nip, a region of the surface of the imaging member soaked with dampening fluid may be damp, and upon contacting the transfer member, will release a small amount (less than 50%) of dampening fluid for transfer to the surface of the transfer member. After the dampening fluid image is transferred to a surface of the transfer member, ink is deposited onto the transfer member, which selectively adheres to the surface according to the dampening fluid image or pattern.

Because a well-constructed dampening fluid absorbing imaging member is expensive, it is desired to remove this constraint. With the jetting of a material consists of a dampening fluid and a significant fraction of carrier solid, good dampening fluid image resolution can be achieved without using an absorbing imaging member. By dividing the functionality between two distinct physical members: imaging member and transfer member, the challenges of cleaning and reuse of the solid carrier can be significantly reduced.

Figure 3:
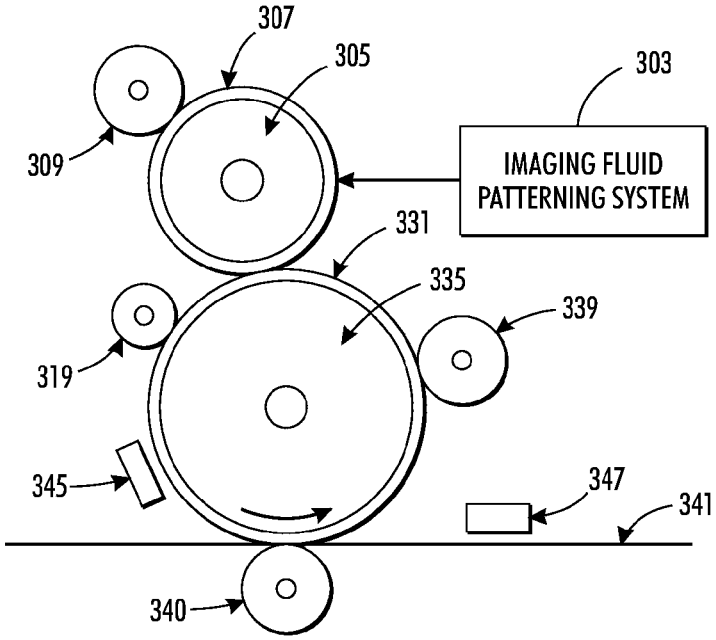
FIG. 3 shows an ink-based digital printing system configured for dampening fluid imaging in accordance with an embodiment.

FIG. 3 shows an ink-based digital printing system in accordance with an embodiment that facilitates formation and transfer before inking of a dampening fluid image, and includes a dampening fluid patterning system 301 configured to jet material including a first component comprising dampening fluid and a second component comprising a solidifying carrier such as wax. Rather than jetting merely liquid dampening fluid, systems in accordance with embodiments use inkjet or inkjet-type devices to jet an image forming liquid material comprising at least a dampening fluid component and carrier component jetted in a single phase at a temperature at which the two or more components are miscible. This embodiment uses an inkjet patterning system that jets the dampening fluid droplets onto an imaging member for subsequent transfer of the resulting fluid image before inking. The fluid image is formed by phase separation as the jetted drops contact the imaging member surface. As the fluid image is passed through a fluid image loading nip, the dampening fluid of the dampening fluid image separates from the imaging member to form a transferred fluid image on a surface of a transfer member at a fluid image loading nip. Ink may be applied to the resulting phase-separated dampening fluid image, selectively adhering to portions of the imaging member surface accordingly.

In particular, FIG. 3 shows an imaging member 305. By jetting a single phase multi-component imaging fluid wherein the carrier component solidifies and separates from a significant fraction of dampening fluid component, good dampening fluid image resolution can be achieved, even without using an absorbing imaging member. It is desired to have a hard and smooth surface 307 for durability and robust cleaning of the solid carrier. For example, ceramics, stainless steel or anodized aluminum can be used as the imaging member surface.

Once the dampening fluid is patterned onto the surface 307 of the imaging member 210, phase-separating from the solid carrier component of the jetted dampening fluid/solid carrier single-phase droplets, a thickness of the dampening fluid dot(s) or layer of jetted material formed of a plurality of droplets may be measured. The inkjet may be controlled to jet dampening fluid/solid carrier in a manner that yields a desired thickness of dampening fluid. The dampening fluid patterning system or subsystem 303 comprising an inkjet is configured for forming a latent image in the uniform dampening fluid layer by image-wise jetting droplets on the imaging member surface.

Systems may include a dampening fluid/solid carrier cleaning system 309. Systems may include contact roller or blade-type cleaning systems for removal of solid component(s) of the dampening fluid/solid carrier material jetted to form the dampening fluid image. Heating can be applied to soften/melt the solid carrier and re-mix the dampening fluid with the solid carrier. Since the dampening fluid and the solid carrier have no contact with the ink or the paper substrate, contamination is minimized and the removed dampening fluid and carrier can be readily reused.

Systems may include an inker 319 for applying ink to a surface 331 of a transfer member 335. Systems may include a transfer member cleaning system 339 for removing ink from the transfer member after transfer of an ink image to media.

The transfer member 335 may be configured to form a dampening fluid pattern or image loading nip with the imaging member 305 such that a dampening fluid image deposited on a region of the imaging member surface 307 is transferred to the transfer member surface 331 under pressure at the nip. The image formed on the surface 307 comprises solid carrier dampened by phase-separated liquid dampening fluid, while the image transferred to and formed on the transfer member surface 331 comprises liquid dampening fluid prior to inking. In particular, a light pressure may be applied between the transfer member surface 331 and the imaging member surface 307 to facilitate dampening fluid image transfer. The amount of dampening fluid transferred may be adjusted by contact pressure adjustments.

After the dampening fluid image is transferred to the transfer member 335, ink from the inker 319 may be applied to a transfer member surface 331 to form an ink pattern or image. The ink pattern or image may be a negative of or may correspond to the dampening fluid pattern. The ink image may be transferred to media at an ink image transfer nip defined by a substrate transport roll 340 and the transfer member 335. The substrate transport roll 340 may urge a paper transport 341, for example, against the transfer member surface 331 to facilitate contact transfer of an ink image from the transfer member 335 to media carried by the paper transport 341.

Systems may include rheological conditioning system 345 for increasing a viscosity of ink of an ink image before transfer of the ink image at the ink image transfer nip. Systems may include a curing system 347 for curing an ink image on media after transfer of the ink image from the transfer member 335 to media carried by the paper transport 341, for example. The rheology conditioning system 345 may be positioned before a transfer member 335, with respect to a media process direction. The curing system 247 may be positioned after a transfer member 335, with respect to a media process direction. After transfer of the ink image from the transfer member 335 to the media, residual ink may be removed by a transfer member cleaning system 339.

After transfer of the dampening fluid pattern from the imaging member surface 307, the imaging member 305 may be cleaned in preparation for a new cycle. Various methods for cleaning the imaging member surface 307 may be used, including high pressure, squeegee-type devices, heat, convection, blotting and vacuum systems, etc. A combination of these methods may be implemented, and may be preferred. The high pressure cleaning method may employ a pressure that is significantly higher than a pressured used at the dampening fluid pattern loading nip defined by the transfer member 335 and its surface 331, and the imaging member 305 and its surface 307.

Figure 4:
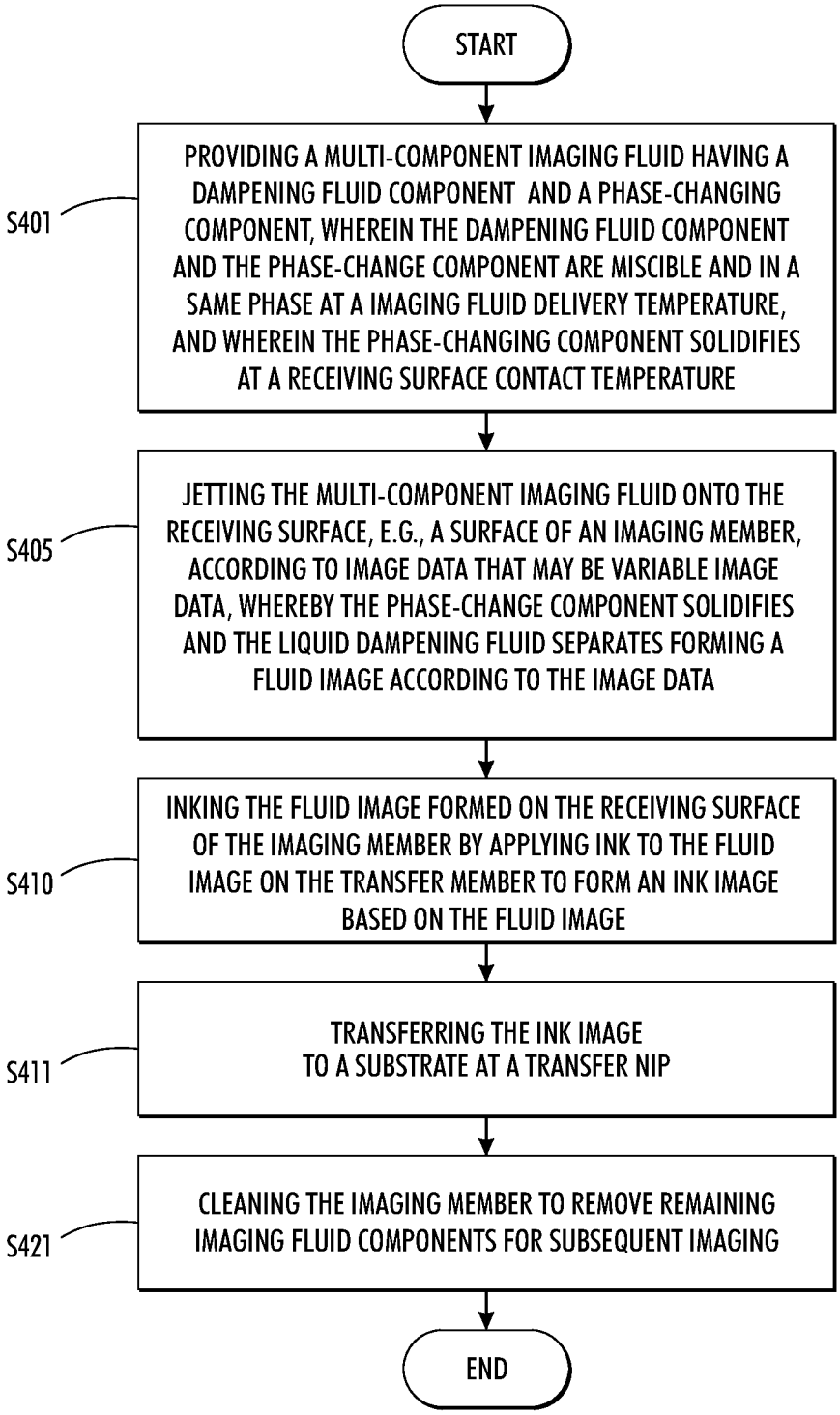
FIG. 4 shows methods of solid ink-based digital printing in accordance with embodiments.

FIG. 4 shows methods 400 for ink-based digital printing using a variable data lithography printing system configured for digital lithographic printing in accordance with an embodiment. Methods may include providing at S401 a multi-component imaging fluid having a dampening fluid component and a phase-changing, or solidifying carrier component that are miscible and in a same phase at an imaging fluid delivery temperature, and phase-separating at a lower temperature, e.g., a temperature of the dampening fluid and carrier upon contacting the imaging member surface.

Methods may include jetting imaging fluid material onto an imaging member surface according to image data, so that patterned dampening fluid image is formed at S405 as a first dampening fluid component of the imaging fluid phase-separates from a carrier component that solidifies upon contacting the imaging member surface. The imaging material is dampening fluid and carrier that is jetted at a temperature at which the components are miscible, and in a single substantially liquid phase. As the jetted material contacts the imaging member surface and cools, the solid carrier solidifies to prevent undesirable spreading of the jetted droplet containing it, and the dampening fluid migrates to a surface of the solid carrier, dampening the carrier and forming a dampening fluid image.

Methods may include inking a surface of the imaging member having the dampening fluid image overlaying the solid carrier at S410. For example, the ink may adhere to portions of the imaging member to form a negative or positive image corresponding to the dampening fluid image.

Methods may include transferring the ink pattern or image formed by inking at S410 to a substrate at S411. The substrate may be any now known or later developed substrate suitable for recording ink patterns. The ink may be transferred to a substrate such as a paper carried by a substrate transport path. The substrate transport path may be configured to carry a substrate through the transfer nip formed by the imaging member and the substrate transport roll. The ink image may be conditioned to increase the viscosity of the ink in preparation for effective transfer of the ink image at a pressure nip formed by the imaging member and a substrate transport roll. In particular, methods may include pre-curing the ink image, or adjusting rheological properties of the ink forming the ink image before transfer of the ink image to a substrate such as paper or packaging.

Methods may include cleaning the imaging member at S421 to remove ink remaining after ink pattern or image transfer. Methods may include cleaning the imaging member at S421. In particular, the imaging member may be cleaned by a cleaning system configured to remove dampening fluid and/or solid carrier remaining on the imaging member surface.

Figure 5:
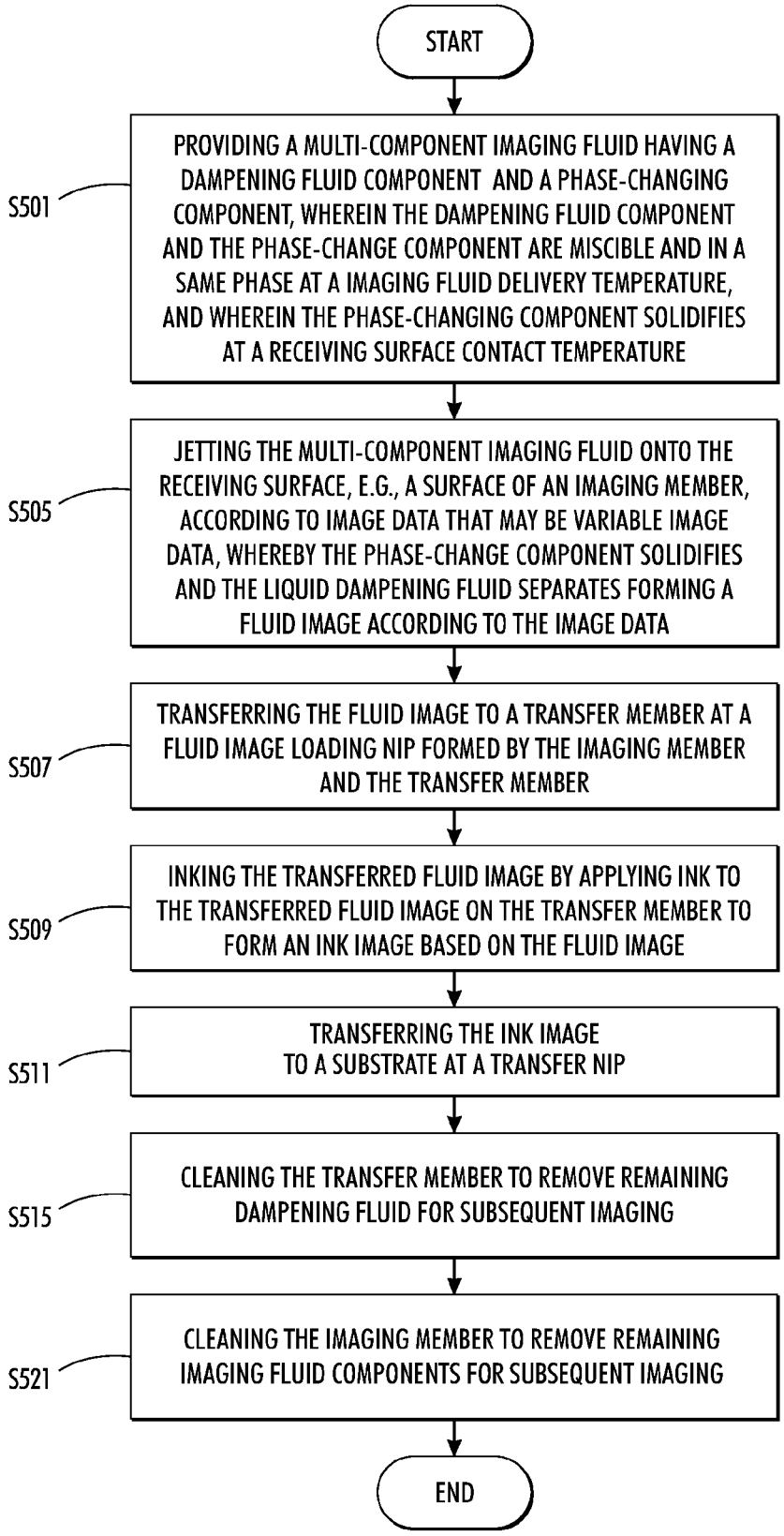
FIG. 5 shows methods of solid ink-based digital printing in accordance with embodiments.

FIG. 5 shows methods 400 for ink-based digital printing using a variable data lithography printing system configured for digital lithographic printing in accordance with an embodiment that may be useful, for example, with a system such as that shown in FIG. 3. Methods may include providing at S501 a multi-component imaging fluid having a dampening fluid component and a phase-changing, or solidifying carrier component that are miscible and in a same phase at an imaging fluid delivery temperature, and phase-separating at a lower temperature, e.g., a temperature of the dampening fluid and carrier upon contacting the imaging member surface.

Methods may include jetting imaging fluid material onto an imaging member surface according to image data, so that patterned dampening fluid image is formed at S505 as a first dampening fluid component of the imaging fluid phase-separates from a carrier component that solidifies upon contacting the imaging member surface. The imaging material is dampening fluid and carrier that is jetted at a temperature at which the components are miscible, and in a single substantially liquid phase. As the jetted material contacts the imaging member surface and cools, the solid carrier solidifies to prevent undesirable spreading of the jetted droplet containing it, and the dampening fluid migrates to a surface of the solid carrier, dampening the carrier and forming a dampening fluid image.

Methods may include transferring the dampening fluid pattern or image at S507 to a transfer member. In particular, the dampening fluid image may be transferred under contact pressure at a dampening fluid pattern (or image) loading nip formed by the imaging member and the transfer member. The dampening fluid image may be split, stamped, or contact transferred to the transfer member from the imaging member at the loading nip at S507, leaving the solid carrier component on the imaging member surface.

Methods may include inking a surface of the transfer member at S509 having the transferred dampening fluid image disposed thereon. For example, the ink may adhere to portions of the transfer member surface to form a positive or negative image of the dampening fluid image.

Methods may include transferring the ink pattern formed by the inking at S509 to a substrate at S511. The substrate may be any now known or later developed substrate suitable for recording ink patterns. The ink may be transferred to a substrate such as a paper carried by a substrate transport path. The substrate transport path may be configured to carry a substrate through the transfer nip formed by the transfer member and the substrate transport roll. The ink image may be conditioned to increase the viscosity of the ink in preparation for effective transfer of the ink image at a pressure nip formed by the transfer member and a substrate transport roll. In particular, methods may include pre-curing the ink image, or adjusting rheological properties of the ink forming the ink image before transfer of the ink image to a substrate such as paper or packaging.

Methods may include cleaning the transfer member at S515 to remove ink remaining after ink pattern or image transfer from the transfer roll to the substrate. Methods may include cleaning the imaging member at S521. In particular, the imaging member may be cleaned by a cleaning system configured to remove dampening fluid and/or solid carrier remaining on the imaging member surface after transfer of a dampening fluid image from the imaging member to the transfer member at S507.

Systems and methods of embodiments for ink-based digital printing accommodate high resolution jetting of dampening fluid on an imaging member without excessive amounts of dampening fluid approaching the inker associated with a transfer member. Systems and methods obviate costs and print speed limitations associated with high powered laser imagers of related art ink-based digital printing systems.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An ink-based digital printing system useful for ink printing, comprising:

an imaging member having a surface at a surface temperature;

a dampening fluid patterning system comprising an inkjet configured to form a latent image by jetting droplets on the surface of the imaging member, wherein each jetting droplet comprises dampening fluid and carrier in a single fluid phase at a jetting temperature, wherein at the imaging member each jetting droplet spreads and holds a spot size of less than 50 micrometers, and wherein the jetting temperature is higher than the surface temperature;

wherein the carrier solidifies upon contacting the imaging member and reaching a temperature lower than the jetting temperature;

wherein upon contact with the surface of the imaging member the jetted droplet will phase separate into a solid component and a liquid dampening fluid component that migrates to a surface of the solid component enabling formation of a dampening fluid layer;

a transfer member, the transfer member being configured to receive a dampening fluid pattern from the surface of the imaging member, the transfer member and the imaging member being arranged to define a dampening fluid image loading nip for contact transfer, the dampening fluid being separate from and immiscible with solid carrier on the imaging member surface; and an inker system, the inker system being configured to apply ink onto the transfer member having the transferred dampening fluid layer pattern to form an ink image based on the dampening fluid pattern.

2. The system of claim 1, wherein the dampening fluid is selected to be liquid at room temperature.

3. The system of claim 1, wherein the jetted dampening fluid forming a high resolution image on the surface of the imaging member and wherein the dampening fluid layer is about 0.1 micrometers to 1.0 micrometer thick.

4. The system of claim 1, the dampening fluid comprising fountain solution.

5. The system of claim 4, comprising:

an imaging member cleaning system, the imaging member cleaning system including a heating system and a doctor blade.

6. The system of claim 1, the carrier comprising paraffin.

7. The system of claim 1, the dampening fluid and the carrier being miscible and in a same phase at a temperature of the dampening fluid and carrier as jetted from the patterning system.

8. The system of claim 1, the dampening fluid comprising a silicone fluid.

9. The system of claim 1, wherein the dampening fluid and the carrier are miscible and in a same phase at a temperature of the dampening fluid and carrier as jetted from the patterning system, and the dampening fluid is selected to be liquid at room temperature.

10. A method for ink-based digital printing, comprising:

forming a dampening fluid pattern on a surface of an imaging member by jetting material in a single phase, the material comprising dampening fluid and carrier in a single fluid phase at a jetting temperature and wherein a droplet of the jetting material when at the imaging member fractions into a solid component and a liquid dampening fluid component that migrates to a surface of the solid component enabling formation of a dampening fluid layer with a spot size of less than 50 micrometers;

wherein the carrier solidifies upon contacting the imaging member and reaching a temperature lower than the jetting temperature;

transferring the dampening fluid pattern to a transfer member at a dampening fluid pattern loading nip defined by the transfer member and the imaging member; and inking a surface of the transfer member having the dampening fluid pattern to produce an ink pattern according to the dampening fluid pattern.

11. The method of claim 10, comprising:

transferring the ink pattern to a substrate at an ink pattern transfer nip formed by the transfer member and a substrate transport system.

12. The method of claim 11, wherein the dampening fluid is selected to be liquid at room temperature.

13. The method of claim 10, wherein the dampening fluid and solid carrier are configured whereby the dampening fluid and carrier are miscible at a jetting temperature and are jetted in a single phase, and wherein the dampening fluid and carrier phase separate upon contacting the imaging member, the carrier being deposited in a pattern according to image data, and the dampening fluid leaching to a surface of and dampening the carrier to form the dampening fluid pattern.

14. The method of claim 10, comprising:

transferring the ink pattern to a substrate at an ink pattern transfer nip formed by the transfer member and a substrate transport system, wherein the dampening fluid and solid carrier are configured whereby the dampening fluid and carrier are miscible at a jetting temperature and are jetted in a single phase, and wherein the dampening fluid and carrier phase separate upon contacting the imaging member, the carrier being deposited in a pattern according to image data, and the dampening fluid leaching to a surface of and dampening the carrier to form the dampening fluid pattern, and the dampening fluid is selected to be liquid at room temperature.

* * * * *